United States Patent [19]

Del Grande

[11] 4,417,235

[45] Nov. 22, 1983

[54] AUDIBLE ALARM NETWORK

[76] Inventor: Donald J. Del Grande, 1832 Frankford Ave., Philadelphia, Pa. 19125

[21] Appl. No.: 247,003

[22] Filed: Mar. 24, 1981

[51] Int. Cl.[3] ..... G08B 1/00; G10K 11/00

[52] U.S. Cl. ..... 340/531; 340/384 R; 340/506; 340/522; 340/628; 367/197

[58] Field of Search ..... 340/531, 506, 520, 522, 340/628, 629, 384 R, 384 E, 386, 539, 521, 523; 367/2, 6, 197, 199; 181/19

[56] References Cited

U.S. PATENT DOCUMENTS

| | | | |
|---|---|---|---|
| 3,713,128 | 1/1973 | Wong et al. | 340/526 |
| 4,091,363 | 5/1978 | Siegel et al. | 340/513 |
| 4,117,479 | 9/1978 | Galvin et al. | 340/506 |
| 4,189,720 | 2/1980 | Lott | 340/531 |
| 4,282,519 | 8/1981 | Haglund et al. | 340/628 |

*Primary Examiner*—Donnie L. Crosland
*Attorney, Agent, or Firm*—Steele, Gould & Fried

[57] ABSTRACT

An alarm system for a building has a plurality of audible alarm generating units disposed at various locations throughout the building. Each of the units is within audible range of at least one of the other units. Each alarm unit includes an audible alarm signaling device, a circuit for driving the audible alarm signaling device, a detector for abnormal conditions such as the presence of too much smoke, a detector responsive to the audible alarm signal produced by the other alarms in the system, and a triggering circuit for enabling the alarm driving circuit in response to detection of either the abnormal condition or the audible alarm signal of any other of the alarms in the system. Detection of the abnormal condition at any location in the building will result in activation of all the alarms in the system, providing enhanced warning capacity.

9 Claims, 7 Drawing Figures

AUDIBLE ALARM NETWORK

BACKGROUND OF THE INVENTION

1. Field of the Invention

This invention relates to the field of audible alarms in general, and in particular, to the field of residential smoke detectors, and the like.

2. Prior Art

Among audible alarm systems, the most popular in use today are audible alarm smoke detectors intended for residential use. Such smoke detectors are relatively small, are easy to mount or attach to walls or ceilings and are self-contained. Normally, a small nine (9 v) volt battery is sufficient to power such a detector for at least one year. Means are provided for sounding a soft alarm when battery power falls below safe operational levels. Such detectors typically operate on ionization chamber or photoelectric principles, and some on both. Such smoke detectors are widely sold under a variety of popular trademarks, and are relatively inexpensive. One such detector which has both ionization chamber and photoelectric detectors is described in U.S. Pat. No. 4,225,860-Conforti. The advantage of using both kinds of detectors is that ionization chamber detectors tend to be more sensitive to generally invisible constituents of products of combustion, whereas photoelectric detectors tend to be more sensitive to visible products of combustion. Photoelectric detectors are also more susceptible to generating false alarms, for example on the basis of atmospheric dust or smoke from a cigarette.

In view of the reasonable expense in purchasing one or more smoke detectors, and in view of their sophisticated operation, smoke detectors have become popular and widely accepted. Notwithstanding the justified reliance which the public has demonstrated on such smoke detectors, they suffer from an inherent operational defect.

If, for example, a smoke detector is installed in a basement, and an occupant is in a second or third floor bedroom, either sleeping or listening to loud music, for example, there is a chance that such a person will not hear the alarm being sounded. Even if a number of smoke detectors are disposed at various locations throughout the building, it is apt to take quite some while for detectable products of combustion to reach a smoke detector within ear-shot, or audible range, of that person in order to sound an effective warning. By the time the nearest smoke detector detects a fire, escape routes may already be blocked by the fire.

Heretofore, two approaches have been utilized to deal with this problem. One approach involves an alarm network, having a plurality of alarms, each of which is wire connected to a central control location. Such systems are disclosed in U.S. Pat. Nos.: 3,733,596-Arima; 4,141,007-Kavasilios, et al.; 4,161,727-Thilo, et al.; 4,162,489-Thilo, et al.; 4,176,346-Johnson, et al.; and 4,223,303-Albinger, Jr.. As may be appreciated, such systems require professional installation, as the wiring network must be routed through the entire building. Further, there is a danger that the fire itself will destroy the wire network. Unless such a system can be built integrally with a structure, it is unlikely to be as successful in the marketplace as the self-contained units. Although such systems provide higher levels of safety, they are not considered by most people to be "too inexpensive not to purchase". Such feelings with respect to cost and safety may be the foremost reason that existing smoke detectors are as widely used today as they are.

Accordingly, it has been necessary to devise a system whereby self-contained smoke alarms can be easily interconnected without actually being wired together. One method employed in interconnecting alarms in general, principally with a central location, is the use of radio transmission or ultrasonic sound transmission. Burglar and fire alarm systems according to this approach are described in U.S. Pat. Nos.: 3,192,516-Simpkins, et al.; 3,973,250-Uffelman; 4,001,805-Golbe; 4,160,246-Martin, et al.; 4,189,720-Lott; and 4,191,947-Bouchard, et al., and Japanese Pat. No. 52-51896. Light pulse systems are described in U.S. Pat. Nos.: 3,683,352-West, et al.; 3,714,647-Litman and 3,805,257-Litman, et al.. These approaches require additional sophisticated and expensive circuitry, are subject to interference from adjacent systems, much like automatic garage door openers, and represent a segnificant additional power drain on the battery system. Such an approach is clearly not feasible with self-contained units. Further, neither radio waves, ultrasonic whistles nor brief flashes of light will serve to enhance the alarm capacity (ability to make sounds which attract attention) of an audible alarm unit.

This invention overcomes all of the problems noted above, by utilizing the existing audible alarm signal as the means by which otherwise self-contained smoke alarms can communicate with one another without being wire connected to one another. Every alarm is designed to trigger an alarm signal in response to detecting an abnormal or adverse condition. In the case of smoke alarms, the abnormal condition is the presence of products of combustion in excess of predetermined safety limits. In the case of burglar alarms, a broken window or noise or unauthorized opening might be the abnormal condition sensed. This invention provides an auxiliary triggering mechanism for self-contained audible alarms. A preferred auxiliary triggering mechanism includes a sound detector, such as a transducer or microphone, a sound discriminator, which can identify the presence of an audible alarm of any similar detector by sensing certain characteristics of the sound, and means for enabling the existing audible alarm in the self-contained unit. Various arrangements of ever increasing sophistication can be utilized in the sound receiving and discriminating circuit. Such a circuit may be entirely electrical, or electro-mechanical in nature. If such an auxiliary triggering mechanism were incorporated into a number of self-contained smoke detectors disposed at various locations throughout a home or building, and a fire were to start at that location in the building most remote from a person occupying that building, within a short period of time after activation of the smoke detector closest to the fire, the smoke detector closest to the person would be activated, not necessarily by detection of the fire itself, but by detection of the audible alarm or alarms of the other detectors in the building. A further advantage of this system is that unlike radio, light, and ultrasonic sound based systems, a system according to this invention magnifies and multiplies the very sounds which alert persons to the need to run for safety. People have no means by which to detect radio waves or ultrasonic sounds and flashes of light are not acceptable warning signals, being most often dismissed as spurious and fleeting reflections of unknown origin.

This invention not only provides a reliable means for interconnecting self-contained audible alarms, which will enable all of the alarms in a system to be sequentially activated within a short time, but does so in a manner which utilizes existing components in each self-contained audible alarm, does so in a manner which provides minimum additional drain of limited battery power, and finally, does so in a manner which significantly multiplies that audible warning signal which can be perceived most easily by people. Such a device, incorporated into new audible alarm units, and added onto existing audible alarm units can save lives which are now being lost.

SUMMARY OF THE INVENTION

It is an object of this invention to provide a selfcontained audible alarm which will be automatically activated not only in response to detection of an abnormal or adverse condition, but also in response to detection of the audible alarm signal of another audible alarm unit.

It is another object of this invention to provide a network of such self-contained alarm units within a home or other building.

It is a further object of this invention to provide an auxiliary triggering mechanism for existing self-contained audible alarms, which will enable such alarms to also be triggered in response to detection of the audible alarm signal of another audible alarm unit.

It is another object of this invention to provide an operationally interconnected, but otherwise independent network of self-contained audible alarms, which upon detection by any one alarm of an abnormal or adverse condition, will enable activation of all other alarms in the network, and in so doing, multiply and magnify the perceived alarm signals.

It is yet another object of this invention to provide an audible alarm network as described, which can be easily installed and maintained without professional assistance.

These and other objects are accomplished by an alarm network for a building or the like, having a plurality of audible alarms disposed at various locations throughout the building, each of the alarms being within audible range of at least one other of the alarms, each of the alarms comprising: means for producing an audible alarm signal; means for driving the audible alarm signaling means; means for detecting an abnormal condition; means for detecting an audible alarm signal produced by any other of the alarms in the network; and, triggering means for enabling the alarm driving means in response to detection of either one of the abnormal condition and the audible alarm signal from any other of the alarms in the network, whereby detection of the abnormal condition at any location in the building will result in activation of all of the alarms in the network. It is also possible to form more than one network within a structure.

In an alarm having means for producing an audible alarm signal, means for driving the audible alarm signaling means, means for detecting an abnormal condition, and means for enabling the alarm driving means in response to detection of the abnormal condition, other objects of this invention are accomplished by an auxiliary trigger mechanism comprising: means for detecting an audible alarm signal produced by a second alarm; and, means for also enabling the alarm driving means in response to detection of the audible alarm signal from the second alarm.

In its presently preferred embodiment the abnormal condition is fire, the means for detecting an abnormal condition including at least one of an ionization chamber detector and a photoelectric detector for the products of combustion. The audible alarm signal detecting means comprises a discriminator attuned to at least one identifiable characteristic of the audible alarm signal. It may be simply a narrow band-pass filter, or may include decoding means. The detecting means may further comprise means for timing the duration of the at least one identifiable characteristic, in order to reduce the number and possibility of false alarms. For purposes of convenience in testing and operation, such an alarm according to this invention may further comprise means for inhibiting production of the audible alarm signal for a predetermined time period, during which a number of activated alarms may be sequentially deactivated without an immediate automatic reactivation.

BRIEF DESCRIPTION OF THE DRAWINGS

For purposes of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENT

Figure 1:
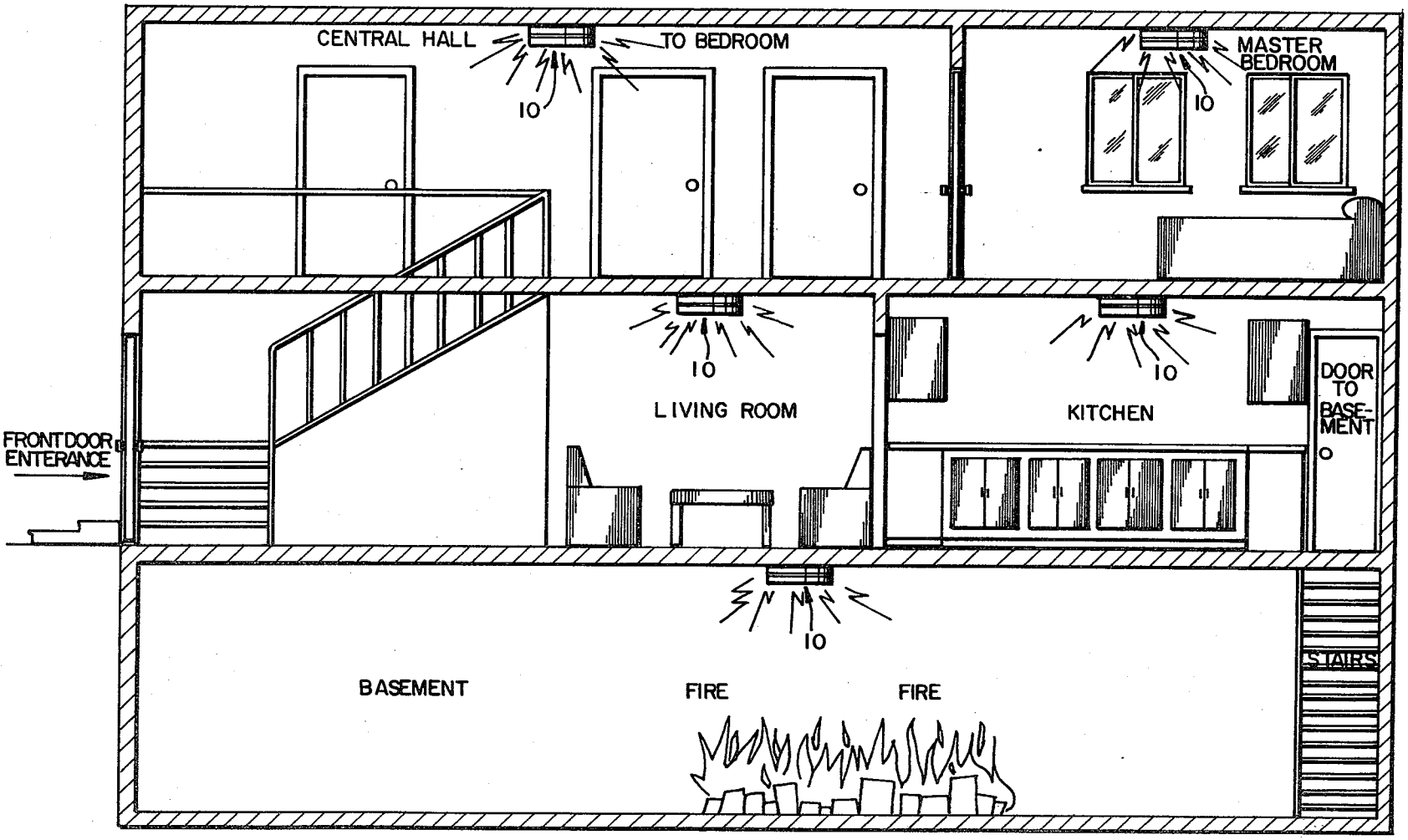
FIG. 1 is a section view of a typical house, having a plurality of smoke detectors disposed at various locations throughout the house, a detectable fire burning in the basement.

An alarm network for a building 8, or the like, having a plurality of audible alarms 10 disposed at various locations throughout the building is shown in FIG. 1. An audible alarm 10, in this case a smoke detector, is disposed in the basement, the kitchen, the living room, the central hallway to the bedroom and in the master bedroom. Even when some of the alarms are disposed on different floors of the building, and even though these alarms may be separated by closed doors, it is clear that an audible alarm having a typically loud alarm signal will be within audible range (with respect to distance) of at least one other of the alarms in the network. The alarm in the basement may not be within audible range of the alarm in the master bedroom, but it is certainly within audible range of the alarm in the kitchen. Even if the alarm in the kitchen is not within audible range of the master bedroom, it is within audible range of the alarm in the living room. Even if the alarm in the living room is not within audible range of the alarm in the bedroom, it is certainly within audible range of the alarm in the central hallway leading to the bedroom. Finally, the alarm in the central hallway is within audible range of the alarm in the master bedroom. Based even upon simple tests of sounding the alarm, one without any skill in the art can determine whether or not a particular alarm is safely within audible range of any other alarm. Such a test would be conducted under the most adverse conditions, for example, with any intervening doors closed and any noise sources, apart from the alarm, activated. The ability to maintain the ease and simplicity of self-installation is a very important part of this invention.

Figure 2:
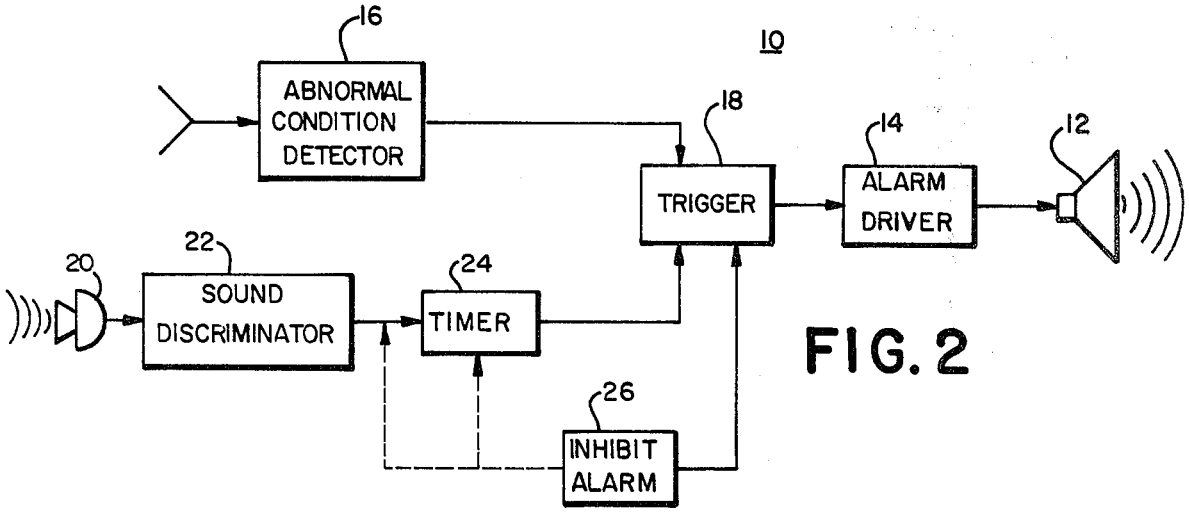
FIG. 2 is a block diagram of an audible alarm according to this invention.

Each alarm 10 according to this invention, and as shown in block diagram in FIG. 2, comprises: an audible alarm, such as horn 12, for producing an audible alarm signal having at least one predetermined or encoded identifiable characteristic; means 14 for driving the audible alarm; means 16 for detecting an abnormal condition; means for detecting an audible alarm signal produced by another alarm; and, triggering means 18 for enabling the alarm driving means in response to detection of either one of the abnormal condition and the audible alarm signal. The means for detecting an audible alarm signal produced by another alarm comprises a microphone or transducer 20, a sound discriminator 22 attuned to at least one identifiable characteristic of the audible alarm signal, and means 24 for timing the duration of the at least one identifiable characteristic, a duration of two (2) to five (5) seconds being presently preferred. The alarm may further comprise means 26 for inhibiting production of the audible alarm signal for a predetermined time period, during which a number of activated alarms may be sequentially deactivated without an immediate automatic reactivation.

Figure 7:
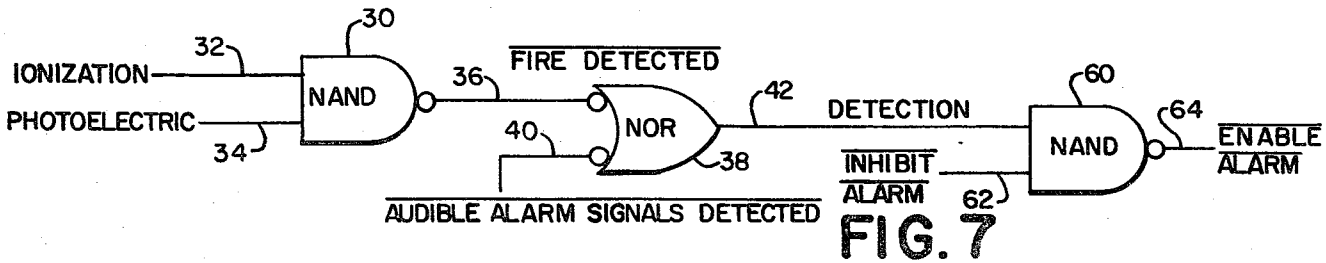

In terms of a fire or smoke detector, the abnormal condition detector 16, trigger 18, alarm driver 14 and audible signaling device 12 are known in the art, and many variations thereof are incorporated into the many smoke detectors now available in the marketplace. One such circuit, which incorporates both ionization chamber and photoelectric detectors is disclosed in U.S. Pat. No. 4,225,860-Conforti, the subject matter of which is incorporated herein by reference. In the dual input fire detector disclosed therein, it is necessary for the alarm to detect both visible and invisible products of combustion in order to sound the alarm. The outputs of the individual detectors form the inputs to a logical AND gate, the output of which determines whether or not the audible alarm signal, in this case a horn, is to be activated. At this point in the circuit, namely at the signal indicating the presence of an abnormal condition, the means for detecting the audible alarm signal produced by another alarm may be connected or interjected, by means of a logical OR gate or the like. Such a circuit is illustrated in FIG. 7. A NAND gate 30 has two inputs 32 and 34. A high voltage or logic level "1" on line 32 indicates that the ionization chamber has detected predominantly invisible products of combustion. A high or logic level "1" on input line 34 indicates that the photoelectric cell has detected predominantly visible products of combustion. When both input lines 32 and 34 are high, indicating that a fire has been detected, the output line 36, designated $\overline{\text{FIRE DETECTED}}$, goes low, a logic level "0". In conventional fashion, signals which are "active low", "low voltage true" or "high voltage false" at a particular place in the circuit are indicated by a line or "bar" over the signal name. Line 36 forms one input to a NOR gate 38. NOR gate 38 has a second input line 40. Input line 40 is connected to that signal which indicates that the audible alarm signal of another smoke detector has been detected, the signal being designated $\overline{\text{AUDIBLE ALARM SIGNAL DETECTED}}$. When either input 36 or 40 goes low, a logic level "0", the output line 42, designated DETECTION, of NOR gate 38 goes high, a logic level "1", indicating that an alarm condition exists. Depending upon the particular design chosen for the circuit, the logical functions could be performed by various positive rather than negative logic gates, or a mixture thereof. In a similar fashion, this invention could be incorporated into a combination fire and burglar alarm, as that shown in U.S. Pat. No. 3,678,511-Benedict, the teachings of which are incorporated herein. However the connection is accomplished, it can be seen that the additional triggering mechanism interferes to a minimum extent with existing detector circuitry.

Irrespective of the abnormal condition which is to be detected, which need not necessarily be fire or smoke, a suitable alarm driver, including an audio signal generator is disclosed in U.S. Pat. No. 4,079,271-Peil, the subject matter of which is also incorporated herein. Those frequencies of sound most audible to persons are in the range of from 2,500–3,000 Hertz (Hz). Most smoke detectors, for example, have audible alarm signals within that range. Accordingly, the simplest of the presently preferred embodiments for the sound discriminator 22 is a narrow band-pass filter attuned to the chosen or existing operating frequency of the audible alarm signal. The band-pass filter should be as narrow as possible, in order to reduce the possibility of false alarms, and need only be as wide as the actual range of frequencies within which the audible alarm signal will operate. It is expected that as components are manufactured and selected only within certain tolerances, that no two audible alarm signals will be precisely alike, although that is possible. If the audio signal generator includes, for example, a resonant reed relay or a crystal oscillator, or the like, the frequencies can be very closely controlled.

More particularly, the tolerances of components chosen, and the resulting capability of the detector to distinguish between an alarm condition and noise, will of course be a function of cost. At one end of the range of cost, an alarm signal generated by an inexpensive resonant reed relay could be detected using a similar resonant reed switch. At the other end of the range, a temperature compensated crystal oscillator signal could be counted down to the desired frequency and amplified, to be detected and compared to a clock signal generated by a similar oscillator in the receiving alarm unit. It is presently preferred that, for reasons of costs, the oscillator be composed of standard tolerance components (e.g., 5% or 10%), and that the frequency output be adjusted to a predetermined alarm frequency at the center of the band-pass of the detector, using a variable capacitor or potentiometer, when the unit is first built.

In a unit employing the tuned frequency alarm signal and band-pass detector scheme, there are certain frequencies which should be avoided. Inasmuch as many electrical appliances run at the power frequency, any multiple of 60 Hz should be avoided. Similarly, the usual frequencies of television horizontal oscillators and multiples thereof could cause generation of spurious alarm signals.

Figure 3:
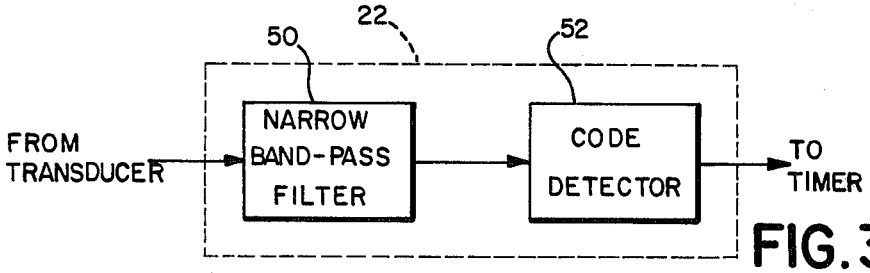
FIG. 3 is a block diagram of one embodiment of the sound discriminator shown in FIG. 2.
Figure 4:
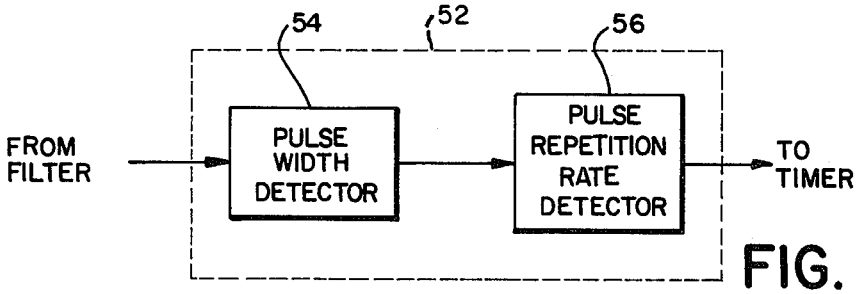
FIG. 4 is a block diagram of one embodiment of the code detector shown in FIG. 3.

In a somewhat more sophisticated version, the sound discriminator 22 may include a narrow band-pass filter 50 and a code detector 52, as shown in FIG. 3. In the event that the audible alarm signal is not a continuous signal, but is a repetitive signal, in order to differentiate or prevent false alarms, it will be necessary not only to detect an audible alarm having the correct characteristic frequency, but also one which has the properly coded on-off characteristic. A suitable code detector 52 is illustrated in FIG. 4, and comprises a pulse width detector 54 and a pulse repetition rate detector 56. Each decoder will be adjusted or tuned in accordance with the encoder which drives the audible alarm signaling device. Each of these elements, the encoder, the narrow band-pass filter, the pulse width detector and the pulse repetition rate detector are well known to those skilled in the art, and need not be precisely illustrated herein.

An operational difficulty has been anticipated in connection with audible alarms according to this invention. If the alarms are being tested, or if all of the alarms have been activated in response to a false alarm, it then becomes necessary to turn all of the alarms off. As a practical matter, it is nearly impossible to arrange turning off each of the alarm simultaneously. Accordingly, as long as any alarm within audible range was still activated, any other alarm which was turned off would immediately thereafter be automatically reactivated. In order to preclude this possibility, means for inhibiting production of the audible alarm is provided. In the simplest of the preferred embodiments, the inhibit alarm may be a timer, electrical or mechanical, which can be set, for example, at 5, 10, or 15 minutes. Alternatively, the length of time may be adjustable. Electronically, the inhibit alarm might be a monostable multi-vibrator or oneshot, having a very long time-out. Alternatively, it might be a simple mechanical countdown timer. The manner in which the inhibit alarm may be connected is also illustrated in FIG. 7. Line 42 forms one input of a NAND gate 60. The other input line 62 is designated $\overline{\text{INHIBIT ALARM}}$. When line 62 is low, a logic level "0", the means 26 for inhibiting the alarm have been activated, indicating no alarm should sound. When line 62 is high, a logic level "1", the means 26 for inhibiting the alarm is inactive, and normal operation is in order. Accordingly, when both inputs 60 and 62 go high, indicating the presence of an alarm condition and the absence of an inhibit alarm instruction, the output line 64, designated $\overline{\text{ENABLE ALARM}}$, goes low, a logic level "0", whereby the audible alarm is sounded. If input line 62 is low, indicating the presence of an inhibit alarm instruction, output line 64 will be locked high, preventing operation of the audible alarm. As indicated in FIGS. 2 and 7, it is presently preferred that the INHIBIT ALARM means be connected to the trigger. As shown by the dotted lines in FIG. 2, the INHIBIT ALARM function may also be interjected elsewhere, for example in the timer 24 or in the line between the sound discriminator 22 and the timer 24. If the user is willing to visit each alarm twice, to reactivate inhibited alarms, the function can be accomplished by an on-off switch. However, for a variety of reasons, the reactivation process may be interrupted, forgotten or only partially accomplished. This defeats the otherwise "fail-safe" nature of the of the alarm, and is not presently preferred.

Figure 5:
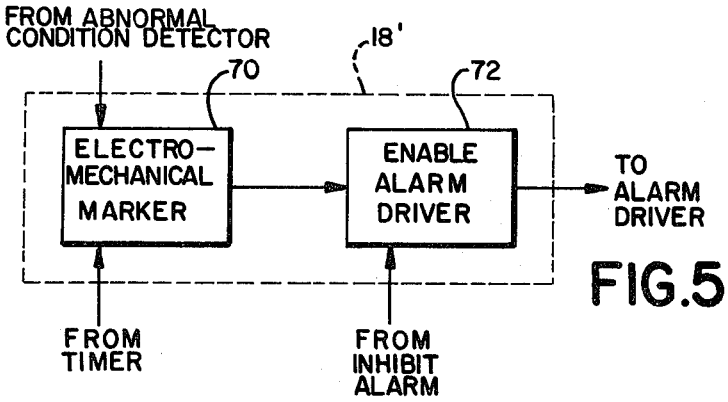
FIG. 5 is a block diagram of a circuit by which the audible alarm displays which detection circuit resulted in activation of the alarm.

In the event of repetitive false alarms, or in the aftermath of a fire, it may be desirable to know which of the detectors was activated in response to the abnormal condition, as it will be an indication that the fire began in its vicinity or that a particular alarm unit is defective. An alternative embodiment of the trigger 18 in FIG. 2 which would accomplish this is illustrated in FIG. 5. The outputs of the timer 24 and abnormal condition detector 16 would be inputs to an electromechanical marker 70. In the event of false alarms, a light held by an electronic latch, such as a flip-flop, would be adequate, and if a liquid crystal display were utilized, the power consumption would not be unreasonable. However, a light system would not be suitable where a fire has finally put the alarm out of operation. In such an instance, assuming that destruction of the alarm was not utter and complete, a mechanical marker having a visible indication would be preferable. For example, a magnetic "flag" might be provided which has a brightly colored marking thereon, the position of which would be shifted, perhaps with respect to a number of adjacent windows. The movement of and the position of the "flag" would depend upon whether a signal was received first from the timer or first from the abnormal condition detector. The same signal which sets the mechanical "flag" can also be used as an input to the ENABLE ALARM driver circuitry 72. Resetting the mechanical "flag" can be adapted to initiate the inhibit timer.

Figure 6:
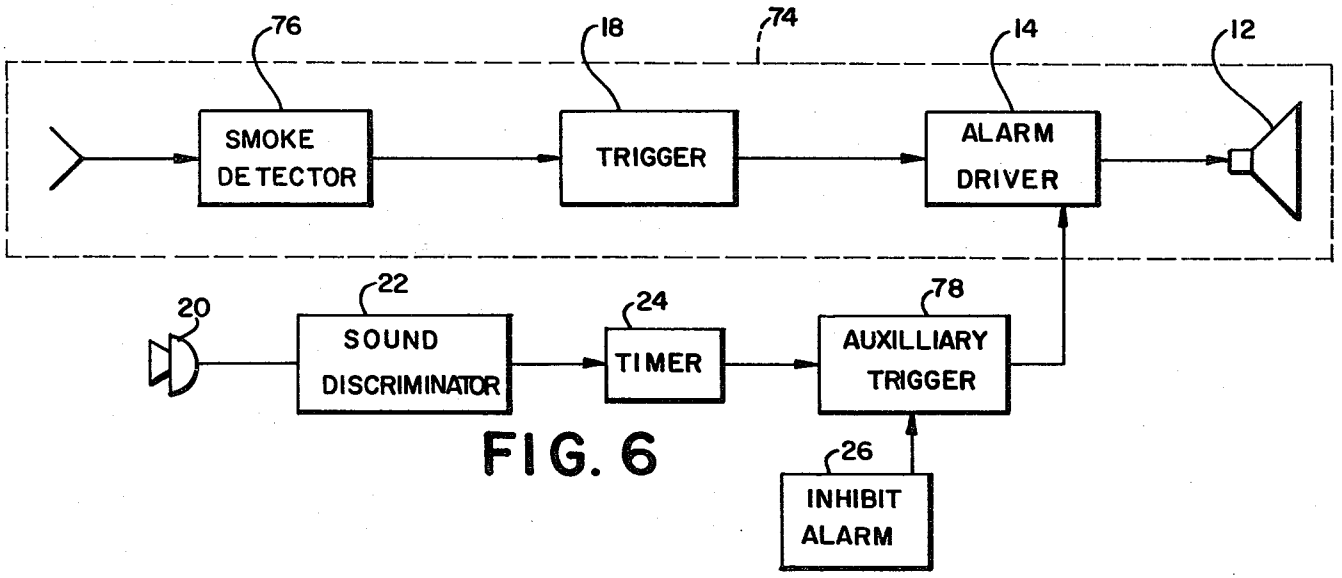
FIG. 6 is a block diagram of an auxiliary triggering mechanism as it would be connected to an existing smoke detector; and, FIG. 7 is a logic diagram illustrating a circuit for connecting an abnormal condition detector, an audible alarm signal detector, an alarm inhibitor and an alarm driver, useful in the embodiments of FIGS. 2 and 6.

It is also contemplated that the principles of the invention can be incorporated into an auxiliary triggering mechanism to be added to existing self-contained audible alarm units. Such a use is illustrated in FIG. 6. Components of the existing alarm are shown in dotted box 74. They include a smoke detector 76, a trigger 18, an alarm driver 14 and an audible alarm signaling device 12. The auxiliary triggering mechanism includes a microphone or transducer 20, a sound discriminator 22, a timer 24, an auxiliary trigger 78 and means for inhibiting production of the alarm 26. The mechanism would be attached or interjected substantially as shown in FIG. 7, and would be powered by the existing battery source.

Overall, this invention provides not only an improved audible alarm, but a simple means by which existing audible alarms may be formed into an operationally unified network which enhances operation for increased safety. In either embodiment, a minimum of additional power is required, as the existing audible alarm signaling devices are utilized as the communicating means between alarms in the system or network. Finally, because the alarms are in fact so utilized as the communicating means, the overall alarm signal, in terms of absolute volume and ability to attract attention, is greatly multiplied. This invention represents a significant advance in audible alarm systems in general, and in smoke detector systems in particular, and has the capability of saving many more lives without significant additional costs.

This invention may be embodied in other specific forms without departing from the spirit or essential attributes thereof, and accordingly, reference should be made to the appended Claims, rather than the foregoing Specification, as indicating the scope of the invention.

I claim:

1. An alarm unit, for directly alerting persons to an abnormal condition, comprising:

means for detecting an abnormal condition;

means for automatically detecting presence of a predetermined audible alarm signal, the signal being a warning sound directly perceptible as such by the persons;

means for generating the same said predetermined perceptible audible alarm signal; and, triggering means for activating the predetermined audible alarm signal generating means in response to said means for detecting an abnormal condition and also in response to said means for detecting an audible alarm signal.

2. An alarm network for directly alerting persons in a building or the like, having a plurality of identical audible alarm units disposed at spaced locations throughout said building, each of said alarm units being within audible range of at least one other of said alarm units, each of said alarm units comprising:

means for producing a predetermined audible alarm signal in response to detection of an abnormal condition, the signal being a warning sound directly perceptible as such by the persons;

means for detecting the same said audible signal when produced by at least one of said alarm units in said network; and, triggering means for enabling said alarm signal producing means in response to said means for detecting said abnormal condition and in response to said audible alarm signal from said at least one of said alarm units in said network, whereby detection of said abnormal condition at any location in said building will result in activation of audible alarms in all of said alarm units in said network, and whereby the audible alarm signal functions as a means of communicating between units of the alarm network and also as a means of warning the persons.

3. In an alarm device having means for producing a predetermined audible alarm signal in response to detection of an abnormal condition, the alarm signal being directly perceptible to persons as a warning, the device being one of a plurality of alarm devices mountable within audible range of one another, an auxiliary trigger mechanism attachable to the means for producing a predetermined audible alarm signal, the auxiliary trigger mechanism comprising:

means for automatically detecting the same said audible alarm signal;

means for activating said alarm producing means in response to detection of said audible alarm signal, whereby the audible alarm signal functions to warn the persons and also to activate at least one other of the plurality of alarm devices.

4. The alarm of claims 1, 2 or 3, wherein the abnormal condition is fire.

5. The alarm of claims 1, 2 or 3, wherein the audible alarm signal detecting means comprises a discriminator attuned to at least one identifiable characteristic of the audible alarm signal.

6. The alarm of claim 5, wherein the audible alarm signal detecting means further comprises means for timing the duration of the at least one identifiable characteristic.

7. The alarm of claim 6, further comprising means for inhibiting production of said audible alarm signal for a predetermined time period, during which a number of activated alarms may be sequentially deactivated without an immediate automatic reactivation.

8. The alarm of claims 1, 2 or 3, further comprising means for inhibiting production of said audible signal for a predetermined time period, during which a number of activated alarms may be sequentially deactivated without an immediate automatic reactivation.

9. The alarm of claims 1 or 2, wherein the means for producing an audible alarm signal further comprises:

an audible alarm signaling device;

means for driving the audible alarm signaling device; and, means for detecting the abnormal condition.

* * * * *